United States Patent [19]

Roth

[11] 4,078,330

[45] Mar. 14, 1978

[54] HELICAL TUBE WITH LAMPS OR ELECTRIC BELLS AND SLIDING BALL

[76] Inventor: Leo Roth, 52-27 69th St., Maspeth, N.Y. 11378

[21] Appl. No.: 726,522

[22] Filed: Sep. 27, 1976

[51] Int. Cl.[2] ..... A63H 33/26

[52] U.S. Cl. ..... 46/227; 46/228

[58] Field of Search ..... 46/45, 47, 227, 228

[56] References Cited

U.S. PATENT DOCUMENTS

| | | | |
|---|---|---|---|
| 2,903,820 | 9/1959 | Bodell | 46/228 |
| 3,758,981 | 9/1973 | Hiasnicek et al. | 46/47 |

*Primary Examiner*—Louis G. Mancene
*Assistant Examiner*—Robert F. Cutting

[57] ABSTRACT

An elongated length of flexible hollow tubing is wound into a helix. First and second battery powered lamps are detachably inserted into the first and second opposite open ends of the tubing. Each lamp has a pair of normally open flexible contacts in the tube. The lamp is dark when its contacts are open and is lit when its contacts are closed. A member is slidable in the tubing and has sufficient weight to close either pair of contacts when engageable therewith. The lamps can be replaced by electric bells.

5 Claims, 3 Drawing Figures

HELICAL TUBE WITH LAMPS OR ELECTRIC BELLS AND SLIDING BALL

BACKGROUND OF THE INVENTION

Helically shaped lengths of hollow tubing are known. It is further known that a member such as a ball can be disposed in the tubing and caused to traverse same from one end to the other by use of gravity or by selectively moving or rotating the tubing. It is known that a ball constrained to move along a particular path can be caused to impinge upon a pair of normally open contacts at an end of the path and to close them. In this invention, these known structures and techniques have been combined to produce a new type of device which can be used as an amusement for children or as a toy or for purposes of exercise.

SUMMARY OF THE INVENTION

In accordance with the principles of the invention, a hollow flexible length of tubing, typically formed of plastic and translucent or transparent, is formed into a helix which can be wrapped detachably about an arm or leg of a child or an adult, or if suitably sized, can be wrapped around the body.

A corresponding one of two identical battery powered light producing means is secured detachably to a corresponding one of the two opposite open ends of the helix. Each means has a pair of normally open flexible contacts disposed in the tube. The corresponding means is deenergized and dark when its contacts are open and is energized and emits light when its contacts are closed.

A member is slidable in the helix. This member is sufficiently heavy to close either pair of contacts when moved into engagement therewith and thus cause light to be produced.

In use, the user's bodily gyrations cause movement of the weight in the helix and thus, causes the weight to move into and out of engagement with the contacts, whereby flashes of light are produced. In addition to their obvious entertainment value, the flashes produced can be used to count the number of bodily gyrations and thus provide a method of monitoring the number and extent of such gyrations which can be performed as exercise. As an alternative to flashing lights, electric bells can be substituted for the lamps whereby rings are produced instead of flashes.

More particularly, the gyrating motion can cause a bell to sound or a light to be lit, and the sound of the bell or the lit light provides a signal to the user or operator informing the user or operator to gyrate with an opposite motion in order to have the member move to the opposite end of the tubing to sound the bell or light the light thereat.

DETAILED DESCRIPTION OF PREFERRED EMBODIMENTS

Figure 1:
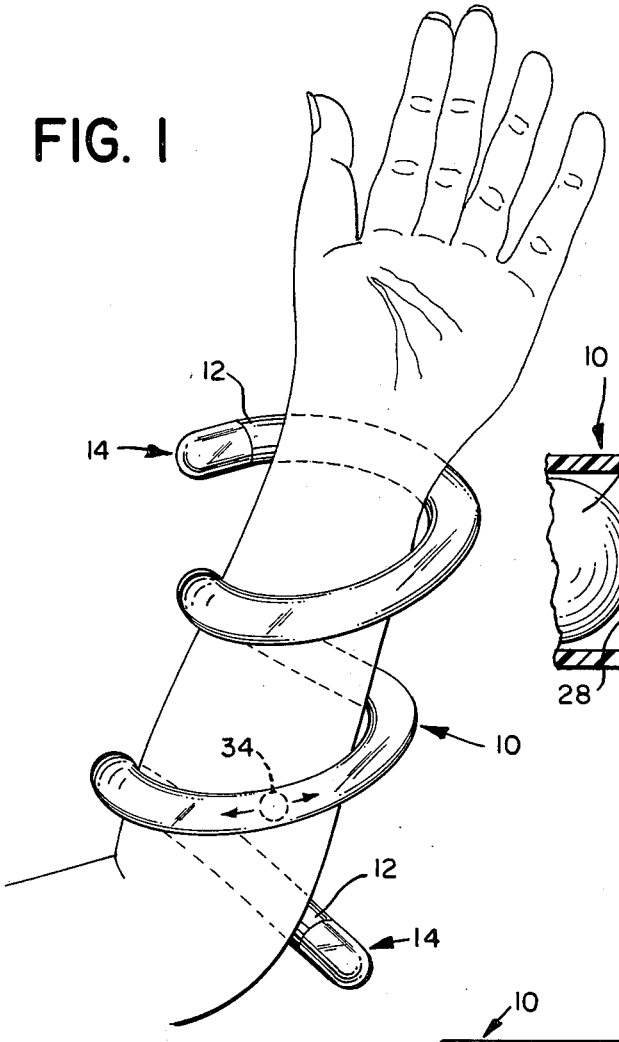
FIG. 1 is a perspective view of a preferred embodiment of the invention.
Figure 2:
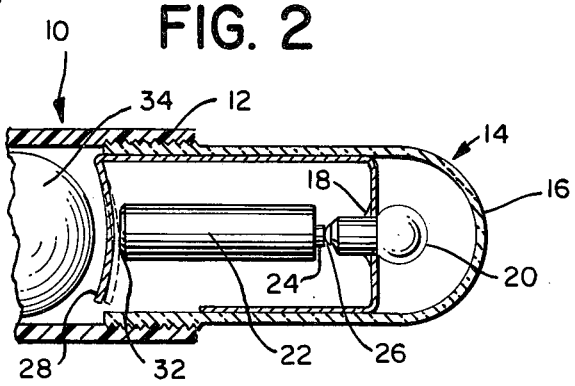
FIG. 2 is a detail view of the invention.

Referring now to FIGS. 1 and 2, a length of polyethylene hollow flexible transparent tubing is wound into a helix 10 of regularly spaced turns. The helix has opposite open ends 12 with internal threads. The length of the helix, its diameter and number of turns can be varied as desired.

Units 14 have external threads which threadedly engage each end, whereby each unit is detachably secured thereto. Each unit includes a transparent or translucent housing 16 curtaining a lamp socket 18 with a removable flashlight type incandescent lamp 20 therein and a removable dry cell 22 having a top terminal 24 directly in electrical contact with the base terminal 26 of the lamp. The side terminal of the lamp is electrically in contact with the socket 18 which is electrically conductive. A first flexible contact 28 is secured at one end to the socket and at the other end extends into the interior of the helix. A second flexible contact 30 is secured at one end to the base terminal 32 of the cell and also extends into the interior of the helix adjacent but spaced from contact 30.

A metal ball 34 (or plastic or wood ball suitably weighted) is disposed in the interior of the helix and is slidable in the tubing. When the ball engages either contact pair 28, 30, the corresponding lamp is lit. As soon as the ball is moved out of contact with the contact pair, contacts 28 and 30 spring apart and the lamp is deenergized and dark.

Figure 3:
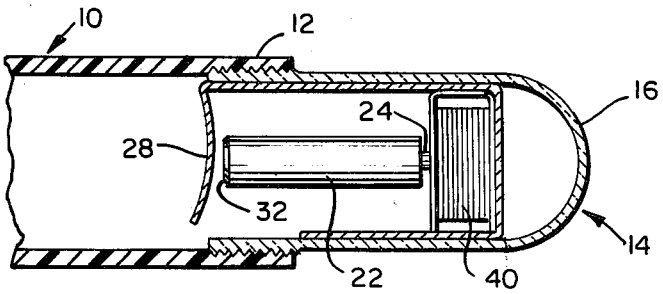
FIG. 3 shows a modification of the invention.

As is shown in FIG. 3, a small electric ball or buzzer 40 can be substituted for each socket and lamp. The operation is the same as described except that the bell is silent when deenergized and sounds or rings when energized. The invention is for use by adults or children and is sized as needed for such application.

While the invention has been described with particular reference to the drawings, the protection sought is to be limited only by the terms of the claims that follow.

What is claimed is:

1. A device comprising:

an elongated length of flexible hollow tubing wound into the shape of a helix having opposite open ends;

first and second battery powered means, each means being secured removably to a corresponding end of the tubing, each means being deenergized and quiescent when its contacts are open and being energized and active when its contacts are closed, said contacts being normally open, said means producing either light or rings when energized; and a member easily movable in the tubing, said member having sufficient weight to close either pair of contacts when moved into engagement therewith, whereby movement of the tubing can cause sufficient movement of the member in the tube to engage a selected contact pair and cause the corresponding means to be energized.

2. The device of claim 1 wherein each means has an open threaded end containing the contact pair and each end of the tubing is threaded whereby each means can threadedly engage the corresponding end of the tubing.

3. The device of claim 2 wherein the tubing is transparent and the member is a sphere which slides in the tubing when the tubing is moved.

4. The device of claim 3 wherein said means are light producing, being dark when deenergized and being light when energized.

5. The device of claim 3 wherein said means produce rings, being quiet when deenergized and producing rings when energized.

* * * * *